US006758418B2

(12) United States Patent
Romanin et al.

(10) Patent No.: US 6,758,418 B2
(45) Date of Patent: Jul. 6, 2004

(54) SWIRL GUN

(75) Inventors: Mario Romanin, Grafton, OH (US); Robert D. Schneider, Vermilion, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/923,594

(22) Filed: Aug. 7, 2001

(65) Prior Publication Data

US 2003/0066910 A1 Apr. 10, 2003

(51) Int. Cl.[7] ..... B05B 1/32; B05B 1/26; B05B 3/00

(52) U.S. Cl. ..... 239/537; 239/461; 239/225.1; 239/327; 239/302

(58) Field of Search ..... 239/461, 225.1, 239/226, 229, 236, 227, 240, 237, 242, 247, 220, 251, 253, 537, 302, 327; 138/153, 172; 222/189, 190, 212

(56) References Cited

U.S. PATENT DOCUMENTS

| | | | | | |
|---|---|---|---|---|---|
| 3,653,598 | A | | 4/1972 | Waldrum | |
| 3,945,538 | A | | 3/1976 | Wightman | |
| 4,204,641 | A | | 5/1980 | Rouse et al. | |
| 4,251,907 | A | * | 2/1981 | Bleckmann et al. | 29/456 |
| 4,369,850 | A | | 1/1983 | Barker | |
| 4,432,496 | A | * | 2/1984 | Ito | 239/327 |
| 4,524,911 | A | * | 6/1985 | Roznieckí | 239/101 |
| 4,611,762 | A | * | 9/1986 | Turner et al. | 239/708 |
| 4,645,127 | A | * | 2/1987 | Emory et al. | 239/299 |
| 4,659,018 | A | | 4/1987 | Shulman | |
| 4,662,565 | A | | 5/1987 | Waldrum | |
| 4,795,094 | A | * | 1/1989 | Correard | 239/229 |
| 4,842,203 | A | * | 6/1989 | Kuhn et al. | 239/705 |
| 4,875,629 | A | * | 10/1989 | Brors | 241/39 |
| 5,040,701 | A | * | 8/1991 | Knickerbocker et al. | 222/153.07 |
| 5,065,943 | A | | 11/1991 | Boger et al. | |
| 5,188,291 | A | | 2/1993 | Cross | |
| 5,405,087 | A | | 4/1995 | Waryu et al. | |
| 5,533,673 | A | * | 7/1996 | Wilson et al. | 239/227 |
| 6,499,673 | B1 | | 12/2002 | Braun, Jr. et al. | |

FOREIGN PATENT DOCUMENTS

| | | |
|---|---|---|
| CA | 1253683 | 5/1989 |
| DE | 398238 | 11/1924 |
| DE | 19855472 A1 | 2/1999 |
| EP | 0203830 A1 | 5/1986 |
| EP | 0852160 A2 | 7/1998 |
| GB | 0239241 A | 4/1926 |

* cited by examiner

*Primary Examiner*—Davis D Hwu
(74) *Attorney, Agent, or Firm*—Calfee, Halter & Griswold LLP

(57) ABSTRACT

A material dispenser having a dispensing tube assembly having an outlet end with an orifice from which material is dispensed onto a surface, and an inlet end having an opening adapted to receive material from a supply during a dispensing operation; and means for imparting orbital motion to said outlet end relative to an axis; the tube assembly having a first section having the inlet end at a first end thereof, a second section having the outlet end at a first end thereof, and a third section that flexibly joins the first and second sections. In one embodiment the flexible third section includes a plurality of rings or hoops to increase hoop strength. A shield liner and air wash features are used to reduce the amount of dispensed material that collects on and in the gun. The dispensing tube is arranged to prevent pivoting movement at a primary pressure seal.

34 Claims, 8 Drawing Sheets

MATCH TO FIG. 1B

SWIRL GUN

FIELD OF THE INVENTION

This invention relates generally to fluid dispensing apparatus of the type having an orbiting spray nozzle. More particularly; the invention relates to an orbital dispensing apparatus having a robust yet flexible dispensing tube assembly.

BACKGROUND OF THE INVENTION

Liquid dispensing apparatus have been designed in a variety of spray gun configurations depending on the type of material being dispensed as well as the configuration of the object or surface being sprayed. One type of dispensing apparatus is an orbiting nozzle type spray gun in which a material dispensing tube is supported for movement at a material inlet end and carries a spray nozzle at a dispensing or outlet end. The dispensing tube extends through the gun relative to a longitudinal reference axis of the gun. The nozzle end typically is journalled in an eccentric bearing. A motor is used to rotate an outer bearing race so as to impart an orbiting or nutating motion to the nozzle relative to the longitudinal axis.

In known designs, the material dispensing tube is a unitary tube that must therefore either pivot at its inlet and or otherwise flex. The pivoting option presents problems because the inlet end of the dispensing tube is also a high pressure end at the material inlet. Therefore, if the seal or tube is broken, and typically the tube pivots on the primary high pressure seal, material can flow into the motor. Although flexible tubes such as plastic can be used, such tubes are not robust and are poorly suited for high pressure applications.

Another problem with known orbiting nozzle guns is that the material being dispensed tends to coat the inside surface of the nozzle shield which is typically a shroud or skirt that surrounds the nozzle.

In known orbiting nozzle apparatus, the use of a low flexibility dispensing tube and/or a pivot region at a main seal, necessitates the use of a longer tube and gun so as to achieve sufficient displacement of the nozzle without over stressing the tube and seal. Longer guns are not only more expensive but also may be more difficult to use or to install into a preexisting spraying system.

It is an object of the present invention to provide an orbiting nozzle spray gun having a more robust dispensing tube. It is another object of the invention to provide a pivot mechanism for an orbiting dispensing tube that does not adversely affect a primary seal at the pivot region. Another object of the invention is to provide a convenient way to reduce or eliminate material residue on the spray gun.

SUMMARY OF THE PRESENT INVENTION

The invention provides a material dispenser having a dispensing tube assembly having an outlet end with an orifice from which material is dispensed onto a surface, and an inlet end having an opening adapted to receive material from a supply during a dispensing operation; and means for imparting orbital motion to said outlet end relative to an axis; the tube assembly having a first section having the inlet end at a first end thereof, a second section having the outlet end at a first end thereof, and a third section that flexibly joins the first and second sections. In one embodiment the flexible third section includes a plurality of rings or hoops to increase hoop strength.

The invention also provides a material dispenser of the orbiting nozzle type in which high pressure fluid seals are static and not adversely affected by the orbiting motion of the dispensing nozzle.

The use of a flexible yet robust dispensing tube permits a dispenser to be realized that is shorter but capable of providing a wide range of spray pattern dimensions without unduly stressing the moving tube assembly.

In accordance with another aspect of the invention, a shield liner is used to prevent excessive accumulation of the dispensed material on the gun components. Still a further aspect of the invention provides an air wash feature that uses pressurized air to reduce the amount of dispensed material from coating parts of the gun.

These and other aspects and advantages of the invention will be readily understood and appreciated from the following detailed description of one or more embodiments of the invention with reference to the accompanying Figures.

DETAILED DESCRIPTION OF PREFERRED AND ALTERNATE EMBODIMENTS

Figure 1A:
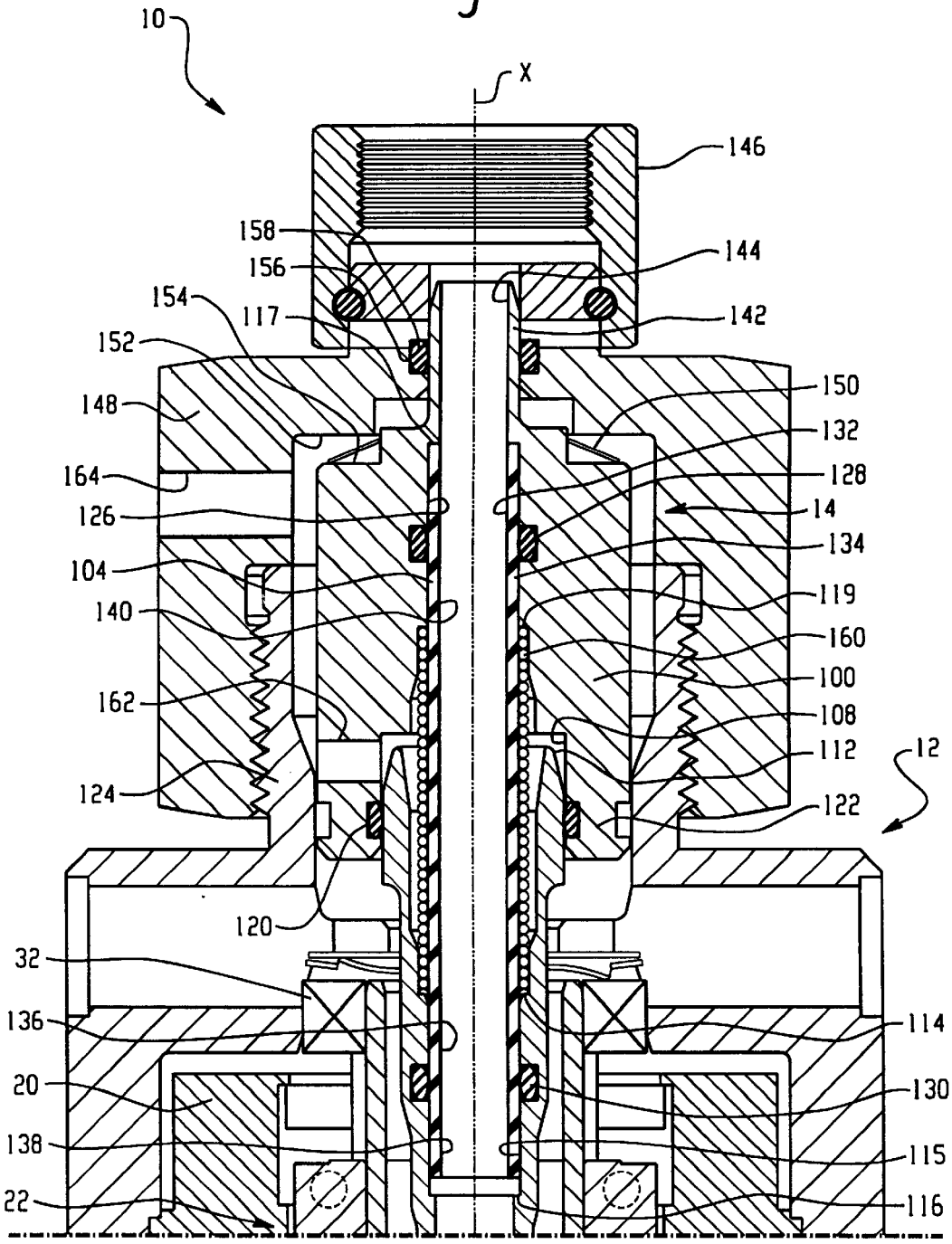
FIGS. 1A, 1B illustrate an embodiment of the invention shown in longitudinal cross-section.

With reference to FIGS. 1A, 1B and 2A, 2B, an exemplary embodiment of the invention is illustrated in the form of an orbiting nozzle liquid dispensing or applicator apparatus, in this case in the form of a spray gun 10. The illustrated spray gun 10 is well suited for dispensing liquids such as adhesives and sealants, however, the gun 10 may be used for dispensing any liquid onto any suitable surface. Various aspects of the invention are embodied in the gun 10, however, those skilled in the art will appreciate that the various aspects of the invention may be used individually or in various combinations depending on a specific gun design or application requirement.

The gun 10 includes three basic sections, namely a motor assembly 12, a material dispensing tube assembly 14, and an eccentric or offset bearing assembly 16. Together, the motor assembly 12 and the bearing assembly 16 provide a drive mechanism or means by which an orbiting or nutating motion is imparted to the tube assembly 14 relative to a reference axis X, which in this embodiment may be the central longitudinal axis of the gun 10. The invention, however, may be realized using other drive mechanisms designed to impart the orbital motion to the tube assembly 14.

The motor assembly 12 may be an electric motor such as a conventional DC brushless motor using PWM power and a Hall sensor for speed control. Many different types of motors may be used and need not be electric. The motor assembly 12 includes a motor housing 18 with a motor stator assembly 20 and rotor assembly 22 installed therein. The rotor assembly 22 includes a rotor 24 that is rotated about the reference axis X by the application of an appropriate electrical drive signal supplied to the stator assembly 20. Electrical power and control wires are routed into the motor assembly 12 via an electrical connector 26 and conduit 28.

The rotor assembly 24 is coupled to and drives a motor output drive shaft 30. In this example, the rotor 24 is coupled to the drive shaft 30 by a threaded connection therebetween. The motor output drive shaft 30 is journalled at one end of the housing 18 in a first shaft bearing 32 and at an opposite end of the housing 18 in a second shaft bearing 34. The drive shaft 30 includes an enlarged diameter internally threaded bearing collar 36. The bearing collar 36 extends outside the motor housing 18. The collar 36 may be integral with the rotor output shaft 30, separately attached, connected thereto or driven thereby. The collar 36 thus rotates at the selected motor 12 speed.

Figure 3A:
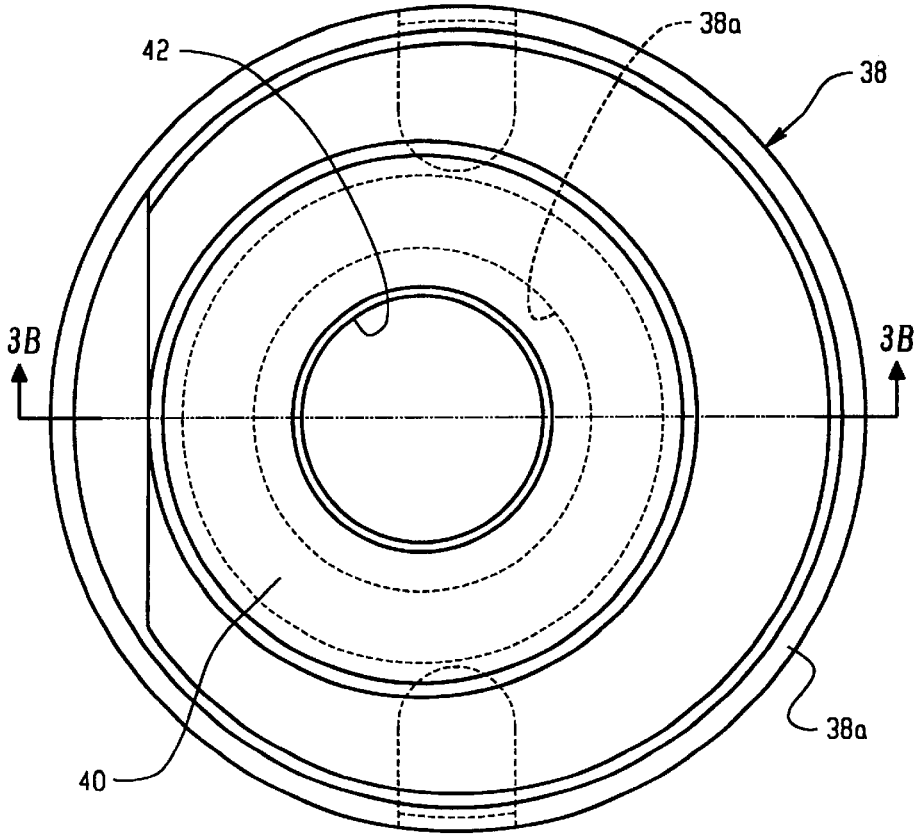
FIGS. 3A and 3B are a plan and cross-sectional view respectively of an eccentric bearing assembly used in the exemplary embodiment of FIGS. 1A, 1B.
Figure 3B:
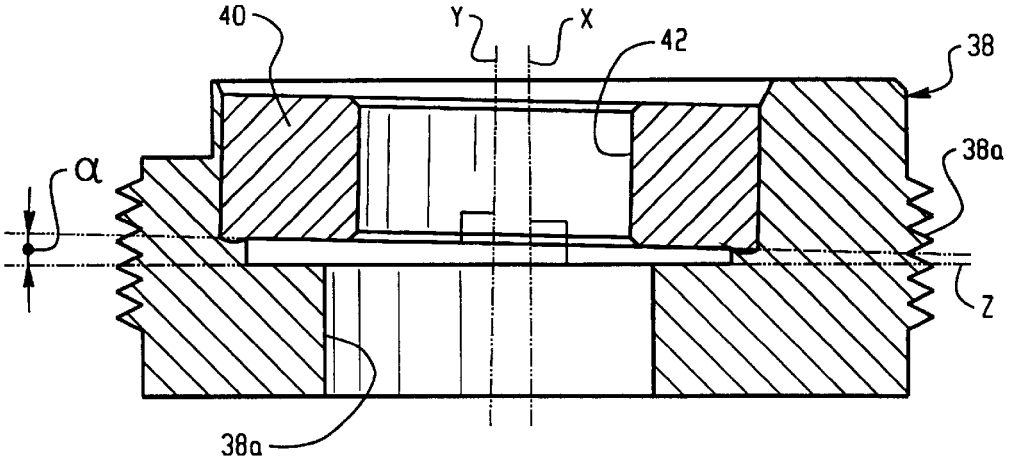

With additional reference to FIGS. 3A and 3B, an externally threaded bearing holder 38 is installed into the bearing collar 36 by threaded engagement between the internal collar threads 36*a* and the external holder threads 38*a*. The collar 36 is reverse threaded from the direction of rotation of the output shaft 30 so that rotation of the shaft 30 does not loosen the threaded connection between the collar 36 and the bearing holder 38.

The bearing holder 38 retains an eccentric bearing 40. The bearing holder 38 functions as an outer bearing race, and the holder 38 rotates with the motor drive shaft 30. Since the inner race bearing 40 is free to spin within the holder 38, the eccentric bearing 40 orbits about the axis X but does not rotate about the axis X, and therefore does not impart any rotation or torque to the tube assembly 14 (although it does impart a nutating or orbiting motion to the tube assembly 14 as will be explained hereinafter). The bearing 40 may be a conventional ball bearing design, although other bearing designs may be used as required.

The eccentric bearing 40 is eccentric in the sense that the bearing 40 has an axially offset tube receiving bore 42. The bearing 40 and thus the tube receiving bore 42 are positioned off-center in the holder 38 such that the bore 42 orbits the central reference axis X as the collar 36 and the holder 38 rotate. The further the bore 42 is positioned off-center from the axis X, the greater will be the angular displacement of the dispensing tube assembly 14, and in particular the output end 14*a* thereof.

Although in this embodiment the bearing 40 is offset from the central rotation axis X of the holder 38, those skilled in the art will recognize that additional alternatives are available so as to provide a tube receiving bore 42 that is radially offset from the axis X in such a manner that the bore 42 orbits the axis X and does not rotate about the axis X. For example, the central bore 42 itself could also be radially off-center in the bearing 40.

The radial off-set arrangement of the bore 42 relative to the axis of rotation X is exaggerated for clarity in FIG. 3B, wherein the central axis Y of the inner bearing bore 42 is radially offset or spaced from the reference axis X (the axis X representing the central axis of rotation of the holder 38). The greater this offset, the greater will be the diameter of the orbit of the nozzle at the end of the dispensing tube assembly 14. The radial offset between the axis of the bearing 40 and the axis of the holder 38 determines the angular offset of the dispensing tube 14 relative to the reference axis X.

Figure 4:
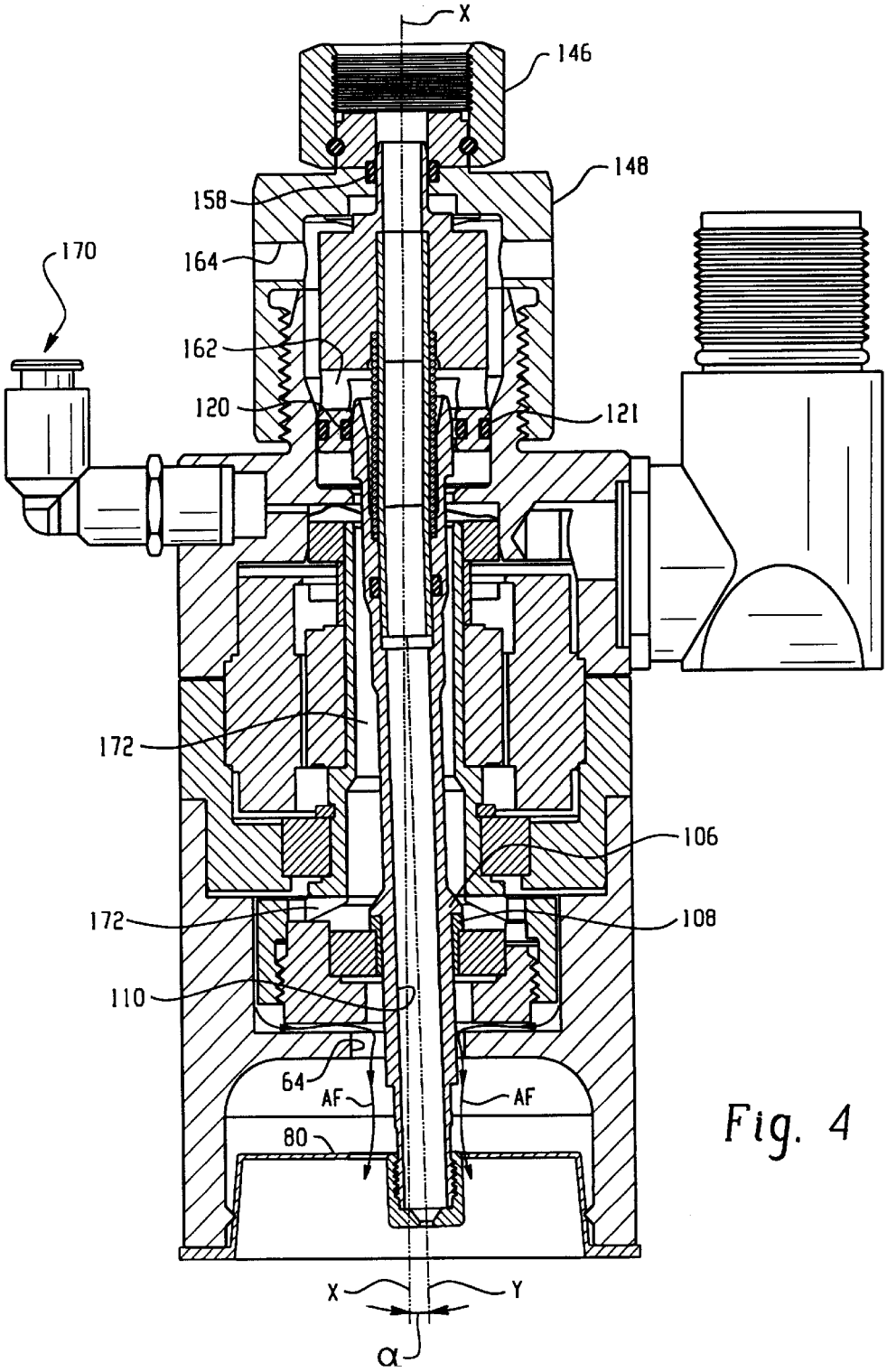
FIG. 4 is another view of the arrangement of FIGS. 1A, 1B in longitudinal section to illustrate the angular offset of the dispensing tube to produce an orbiting motion of the appended nozzle.
Figure 5:
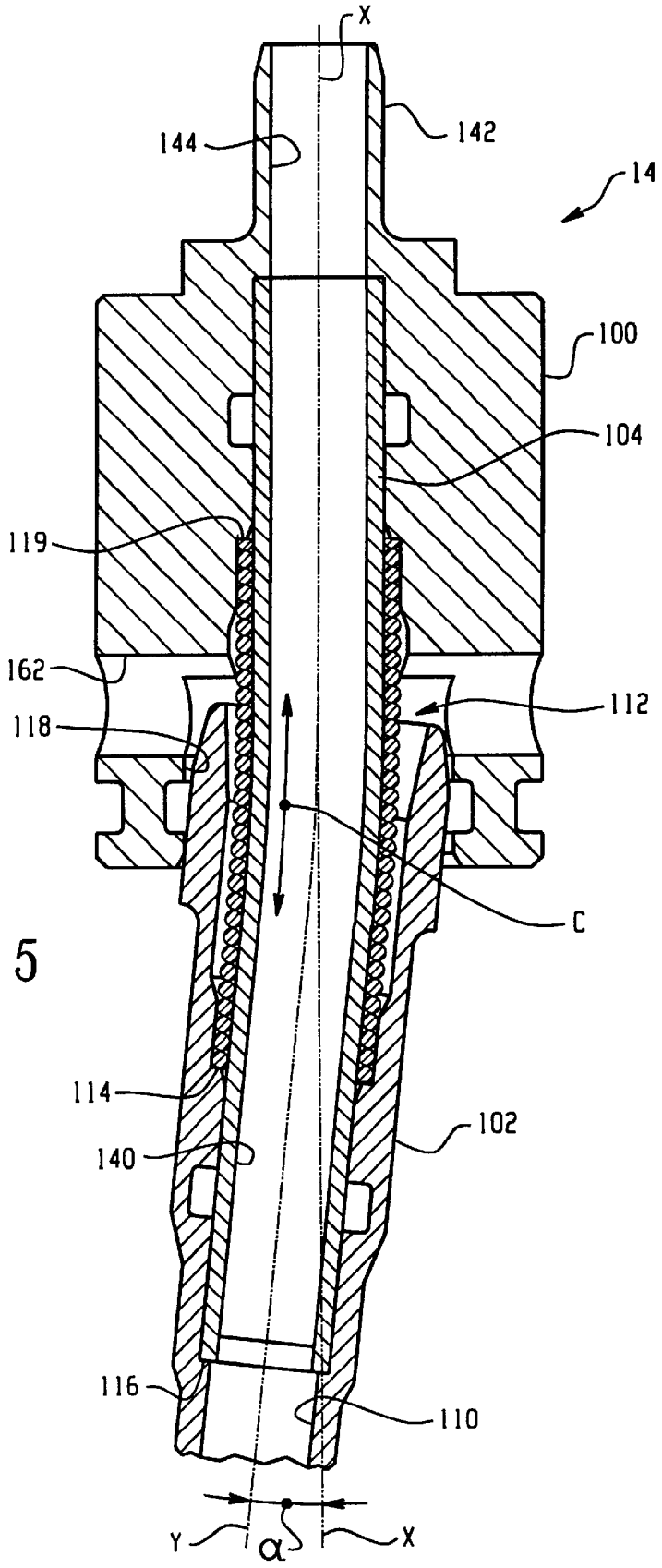
FIG. 5 is an enlarged partial view in longitudinal cross-section of a dispensing tube assembly as used in the exemplary embodiment.

Because the dispensing tube assembly 14 is journalled or otherwise extends through the eccentric bearing 40 via the offset bore 42, the bearing 40 is installed in the bearing holder 38 at an angle $\alpha$ or canted, so that during operation the bearing 40 lies square to the tube assembly 14 to minimize wear and heat generation. The outer race or holder 38 lies coaxial with the drive shaft 36. Thus, the central axis Y of the eccentric bearing 40 lies non-parallel at the angle $\alpha$ to the reference axis X (i.e. the axis of rotation of the motor 12 and the holder 38). This is illustrated in FIGS. 3B and 5. In FIG. 3B, the reference line Z represents an axis that is normal to the reference axis X and defines the square alignment of the holder 38 to the rotation axis X of the motor 12. Thus, the holder 38 is installed square to the reference axis X to freely rotate with the drive shaft 36, whereas the eccentric bearing 40 is canted at an angle $\alpha$ that is less than ninety degrees. The value of $\alpha$ will be selected based on the amount of offset of the bearing 40 within the holder 38. FIGS. 4 and 5 illustrate how the canted eccentric mounting of the bearing 40 produces an angular offset $\alpha$ of the tube assembly 14 relative to the reference axis X.

The rotating holder 38 in combination with the orbiting bore 42 of the bearing 40 thus will impart a nutating or orbiting motion to the output end 14*a* of the tube assembly 14. The dispensing section (102) of the tube assembly 14 will orbit in a manner that generally traces the surface of a cone, with the apex of the cone being generally at the pivot region of the dispensing section (102) of the tube assembly 14. The orbiting portion of the tube assembly 14 however will not be twisted or rotate or otherwise experience torque while nutating because of the near zero torque coupling between the tube assembly 14 and the motor drive shaft 36 via the eccentric bearing 40.

The motor housing 18 includes a reduced diameter end portion 18*a* that forms a boss 50. A spray shield 52 in the form of a bifurcated cup is installed by a slip fit onto the motor housing boss 50. The shield 52 includes at one end a skirt 54 that slides onto the housing boss 50. A number of socket bolts or screws 56 may be used to securely attach the shield 50 to the motor housing 18.

The shield 52 is generally cylindrical in shape and includes a central cross wall 58 that separates the interior of the shield 52 into a first cup portion 60 that receives the bearing holder 38, bearing 40 and drive shaft collar 36; and a second cup portion 62 into which the outlet end 14*a* of the dispensing tube assembly 14 is positioned when installed. The wall 58 serves as a shield against material that is dispensed from the outlet end 14*a* from coating the bearing assembly 16. The wall 58 includes an enlarged central opening 64 through which the tube assembly 14 extends. The opening 64 must be of sufficient diameter to accommodate the angular deflection of the tube assembly 14 as it nutates. The shield 52 may conform to any configuration suited to a particular application.

A nozzle 70 is threadably or otherwise suitably installed on the outlet end 14*a* of the tube assembly 14. The nozzle 70 shapes the pattern of the material as it is dispensed from the outlet orifice 72 of the tube assembly 14. For example but not by way of limitation, the pattern may be an atomized spray pattern, a stream, or a bead of material. Other dispensing patterns may be used as required for a specific application.

An inherent effect that occurs during liquid spraying operations is that the inner surface 74 of the shield 52 becomes coated with the dispensed material. This material can be difficult to remove, and some of the material may pass through the opening 64. To minimize this effect, the present invention contemplates an arrangement by which dispensed material substantially collects on a removable or disposable element rather than the shield 52. In accordance with this aspect of the invention, in the exemplary embodiment of FIGS. 1A, 1B and 2A, 2B, a shield liner 76 is provided. The liner 76 is preferably made of a low cost plastic material and may be used as a disposable item. The liner 76 generally conforms to the interior shape of the shield 52 and provides a barrier to dispensed material. Thus, the liner 76 includes a cup-like portion 78 that substantially surrounds the nozzle 70. The cup portion 78 included a central opening 80 that is appropriately sized to accommodate the nutating motion of the tube assembly 14. In the illustrated example, the liner is press-fit into the shield 52 and held in place by an annular ring or bead 82 formed in the shield 52. In one embodiment, the liner 76 is a pipe cap available from PMI Corporation and modified to include the opening 80.

Figure 6:
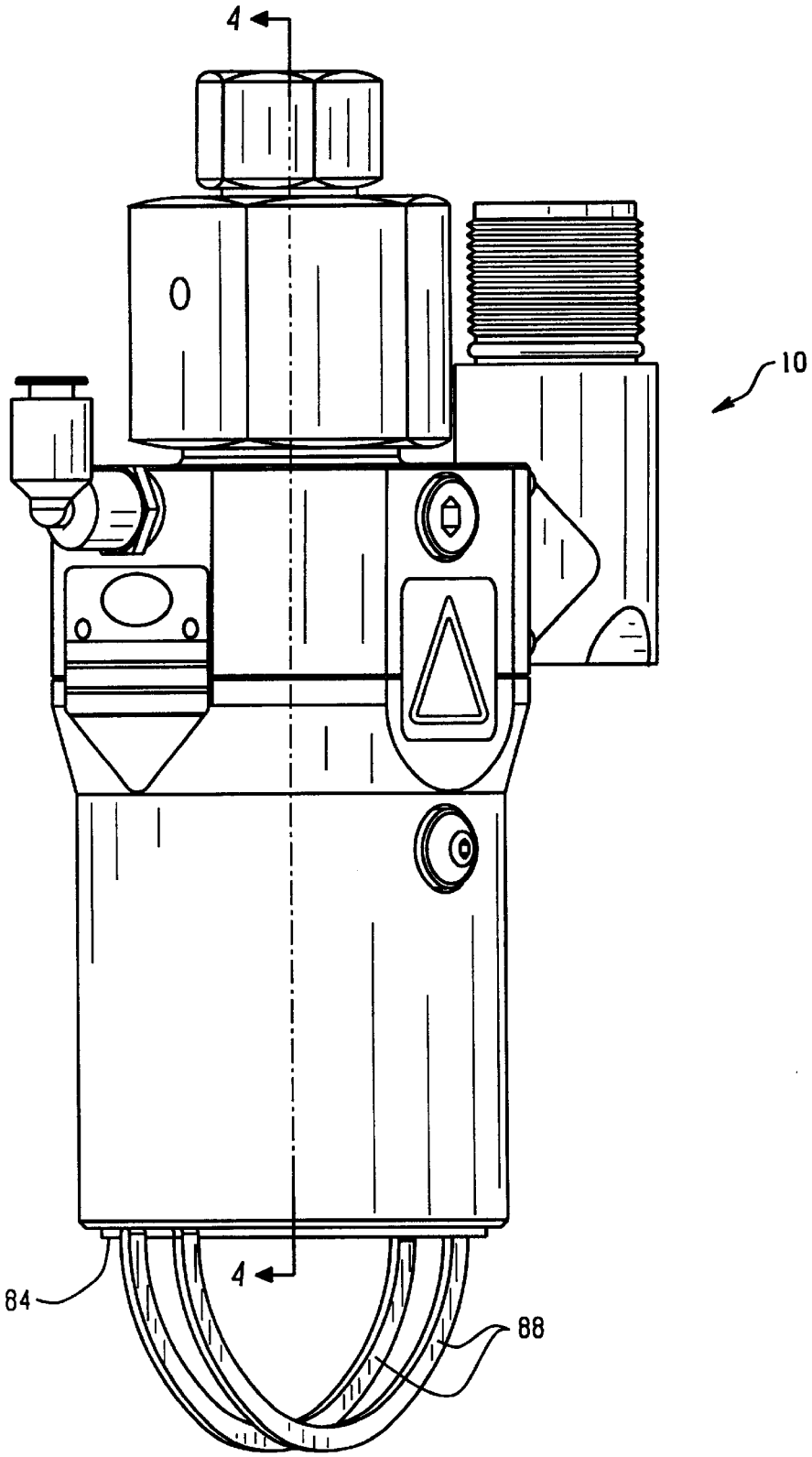
FIG. 6 illustrates in elevation the dispensing apparatus of the preferred embodiment and showing a liner pull feature in accordance with one aspect of the invention.

The liner includes an integral flange portion 84 that seats against the lower end 52*a* of the shield 52. This flange can be grabbed by the operator to remove the liner 76 after sufficient material has collected thereon. The flange 84 may be provided with arcuate slits 86 so as to form tabs or ears 88 or other suitable graspable portion that can be pulled to remove the liner 76 from the shield 52. FIG. 6 illustrates the shield 52 with the ears 88 (in FIG. 6 the ears 88 are moved to the position illustrated by the operator grasping the ears).

In addition to the liner 76, the present invention contemplates an air wash feature to further reduce the amount of material that might accidentally spray or splash through the openings 80, 64 and into the bearing assembly 16. This air wash feature will be described hereinafter.

In accordance with another aspect of the invention, a material dispensing tube design is used that provides a flexible yet robust dispensing tube even at higher pressures (for example, about 3500 psi static pressure). In accordance with another aspect of the invention, a dispensing tube arrangement is provided by which a pivot region of the tube is at a position other than at primary seals against the material. Thus, the primary seals may be realized as true static seals, with the pivot region provided at a backup seal.

FIGS. 1A, 1B, 4 and 5 provide an exemplary embodiment of a dispensing tube arrangement in accordance with the invention. In this exemplary embodiment, the dispensing tube assembly 14 is realized using three joined sections. These sections are a material receiving section 100, a material dispensing section 102 and a flexible section 104. When fully assembled, the dispensing tube assembly is a cartridge style unit 14 that can be easily installed into and removed from the spray gun unit 10.

The materials used to form the tube assembly 14 may be any materials suitable for the liquid material being dispensed. For example, the receiving section 100 and the dispensing section 102 may be a metal such as stainless steel, for example. The flexible section 104 may be a plastic such as nylon or teflon for example. These examples are merely intended to be exemplary and are not an exhaustive list of available materials for the tube assembly 14.

In general though, it is contemplated that the receiving and dispensing sections 100, 102 even if made of non-metallic materials will be substantially more rigid and less flexible than the flexible section 104. In accordance with this aspect of the invention, the receiving and dispensing sections will be substantially more rigid than the joining flexible section 104 such that substantially all of the flexure and bending of the tube assembly 14 is assimilated by the flexible section 104. However, the flexible section 104 cannot be made too compliant and soft because then the flexible section 104 might extrude under pressure through the support element (160). The flexible section 104 should not be too stiff however in order to realize the benefits of the flexibility to assimilate the movement of the assembly 14, and thus have a substantially low resistance to bending. Therefore, the choice of materials for the three sections of the tube assembly 14 may be selected based on, among other things, by the static operating pressures, the dispenser size, the dispensing pattern, and the type of material being dispensed.

The dispensing section 102 of the dispensing tube assembly 14 extends lengthwise through the motor housing 18 and the shield 52. The nozzle 70 is installed on the outlet end of the dispensing section.

Figure 1B:
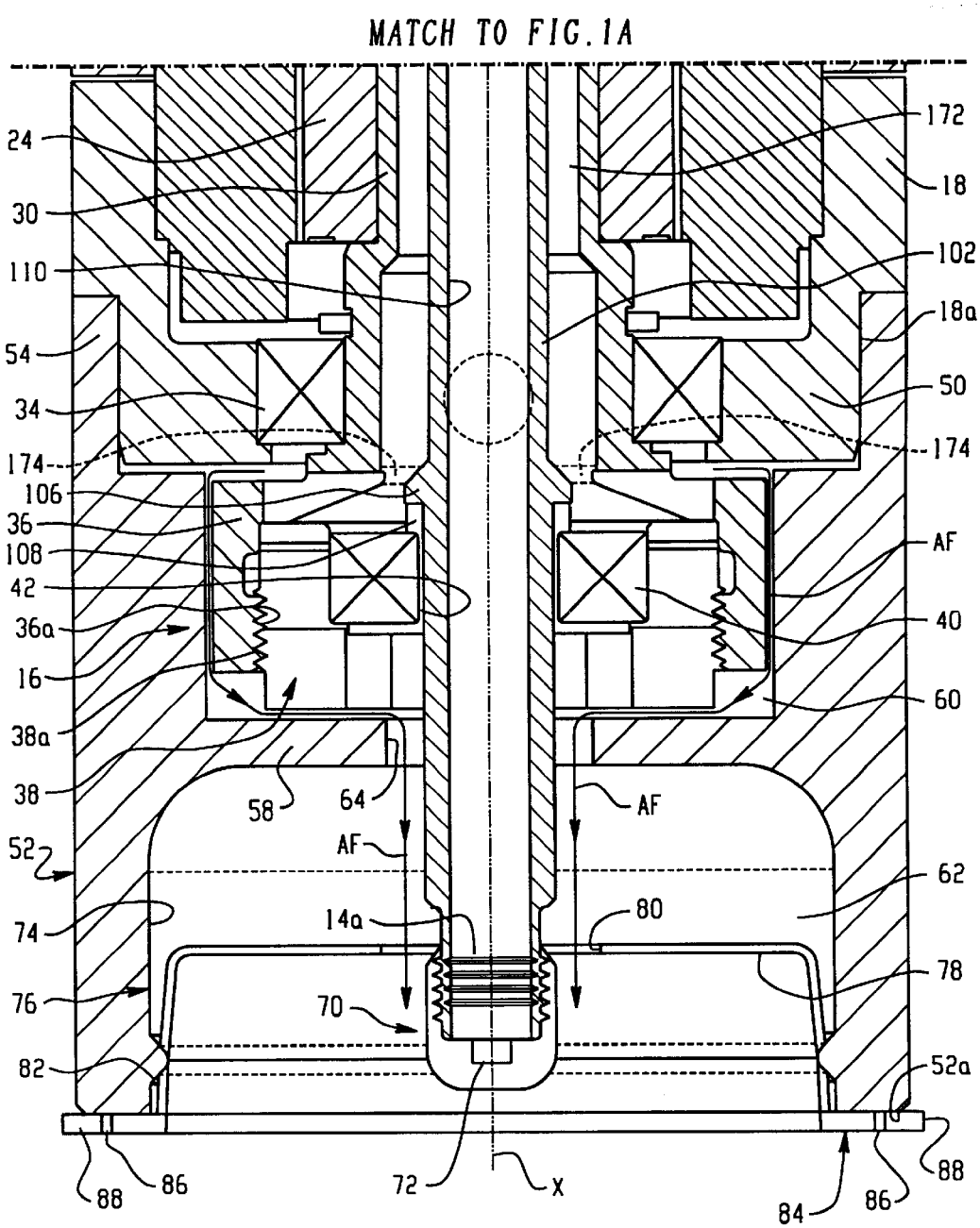

A shoulder or rib 106 is provided on the tube assembly 14 and axially near the eccentric bearing assembly 16 when the gun 10 is fully assembled (as in FIGS. 1A, 1B). A low friction thrust bearing or bushing 108 is installed between the shoulder 106 and the eccentric bearing 40. The thrust bearing 108 may be made of any suitable material, for example, PEEK. The thrust bearing 108 helps assimilate tolerance error that might cause the eccentric bearing 40 to deviate from being substantially square to the tube assembly 14.

The dispensing section 102 includes a central fluid passageway 110 through which material passes to the nozzle 70.

The open or throat end 112 of the dispensing section 102 includes a first lower counterbore 114 and a second lower counterbore 116. The throat 112 of the dispensing section 102 telescopically slips into a counterbore 118 in the lower end of the receiving section 100 of the dispensing tube assembly 14. An o-ring or other suitable seal 120 provides a low friction and flexible pivot region for the pivoting motion between the nutating dispensing section 102 and the stationary receiving section 100. Any suitable low friction interface may be used at the pivot region 120, but an elastomer seal device is preferred since such a flexible seal may be used as a secondary or back up seal should the fluid tight flexible section 104 be compromised or otherwise break or leak.

The counterbore 118 forms a collar 122 at one end of the receiving section 100 of the tube assembly 14. This collar 122 is slideably received in an externally threaded neck 124 of the motor housing 18 and another seal or o-ring 121 provides a seal between the receiving section 100 and the neck 124. The seal 121 forms a barrier to any fluid that might escape from the tube assembly 14 to prevent such fluid from entering the motor 12 assembly.

The material receiving section 100 includes a central bore 126 that closely and snugly receives one end of the flexible section 104 which bottoms on a first upper counterbore 117 that is axially spaced from a second upper counterbore 119. An o-ring or other suitable seal 128 forms one of the primary seals against the fluid pressure of the material being dispensed. An opposite end of the flexible section 104 is closely and snugly received through the throat 112 of the dispensing section 102 and extends into a close receiving snug bore 115. Preferably, the opposite end of the flexible section 104 does not bottom on the second lower counterbore 116, but rather an axial space remains to account for tolerance stack-up. A second o-ring or other suitable seal 130 provides another primary seal against fluid pressure. Note that both primary seals 128, 130 are true static seals. The orbiting or nutating movement of the dispensing section 102 does not adversely affect these static primary seals because the flexible section 104 is snugly constrained on either side of each of the primary seals 128, 130. For example, the portions 132, 134 of the flexible section 104 that are axially adjacent the upper primary seal 128 ("upper" as viewed in FIGS. 2A, 2B) are snug and constrained against movement by the bore 126. Similarly, the portions 136, 138 of the flexible section 104 that are axially adjacent the lower primary seal 130 are snug and constrained against movement by the bore 115. The flexible section 104 defines a central fluid passageway 140 as a continuing upper extension of the fluid passageway 110.

The receiving section 100 of the tube assembly 14 includes a nipple portion 142 that forms an inlet fluid passageway 144. The inlet fluid passageway 144 forms a continuous extension of the lower passageways 110, 140 such that material entering the inlet 144 flows through the joined fluid passageway defined by the bores 144, 140, 110 to the nozzle assembly 70. The nipple 142 extends into a suitable adapter 146 such as may be use to connect a flow control valve (not shown) that regulates the flow of material into the gun 10.

A cap 148 is internally threaded and installed on the threaded neck 124 of the motor housing 18. A disk spring 150 or other suitable live load device is captured between an inner shoulder 152 of the cap 148 and an outer shoulder 154 on the receiving portion 100 of the tube assembly 14. The cap 148 also includes a seal groove 156 that retains an o-ring or other suitable seal 158. The seal 158 is another static primary seal against fluid pressure of the material being dispensed. Again note that this primary seal is not adversely affected by the pivoting movement of the dispensing section 102 of the tube assembly 14.

Because the flexible section 104 is suitably flexible and compliant, it could be subject to bursting under high pressure. Therefore, in order to increase the hoop strength of the flexible section 104 without unduly compromising the flexibility of the section 104, a series of close fitting loops 160 are installed about the central otherwise unsupported portion of the flexible tube 104. In the preferred embodiment, the loops 160 are realized as a helix in the form of the coils of an extension spring (an extension spring having a pre-load on the coils by which the coils are in contact in a free-standing condition), however, individual loops may be used. Other techniques for increasing the hoop strength while maintaining the desired flexibility of the tube 104 may be used. The spring 160 is snugly and closely received in the receiving section 100 of the tube assembly 14 and bottoms on the second upper counterbore 119. The opposite end of the spring 160 is snugly and closely received in the dispensing section 103 of the tube assembly 14 and bottoms on the second lower counterbore 114.

When fully assembled, the cap 148 pushes on the disk spring 150 which forces the tube assembly 14 downward and seats the shoulder 106 against the thrust bearing 108. The spring 160 is fully or near fully compressed.

The material receiving section 100 of the tube assembly 14 is provided with an inner weep hole 162. The weep hole or bore 162 is preferably positioned on the high pressure side of the pivot seal 120. The cap 148 is also provided with a cap weep hole 164 that is in fluid communication with the inner weep hole 162. In the event that the fluid tight integrity of the flexible tube 104 is compromised, material will flow out the weep holes 162, 164 providing a visual indication to the operator that there is an internal leak. The weep holes 162, 164 permit the liquid material to by-pass the pivot seal 120, therefore, the pivot seal will not see system pressure and will easily be able to prevent material from flowing into the motor 12. As soon as an operator sees material leaking from the weep hole 164, the operator can release system pressure and stop the motor 12 so that the secondary seal 120 will easily contain any fluid.

Figure 2A:
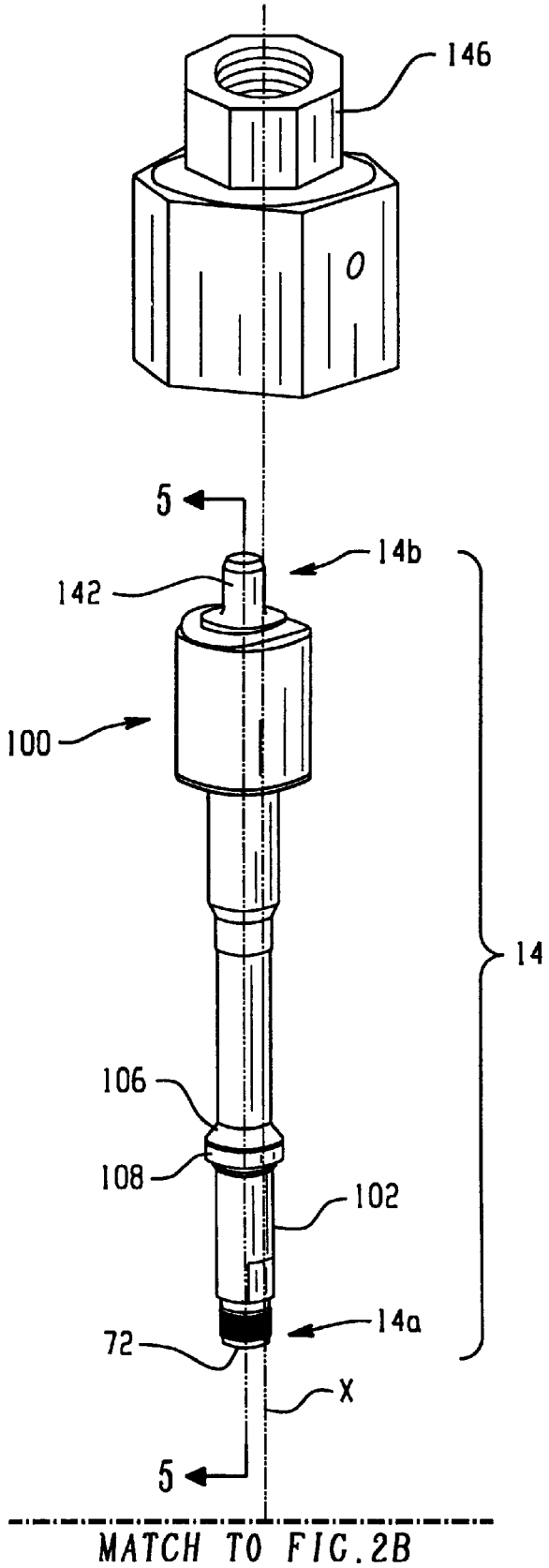
FIGS. 2A, 2B are the apparatus of FIGS. 1A, 1B in an exploded isometric view.
Figure 2B:
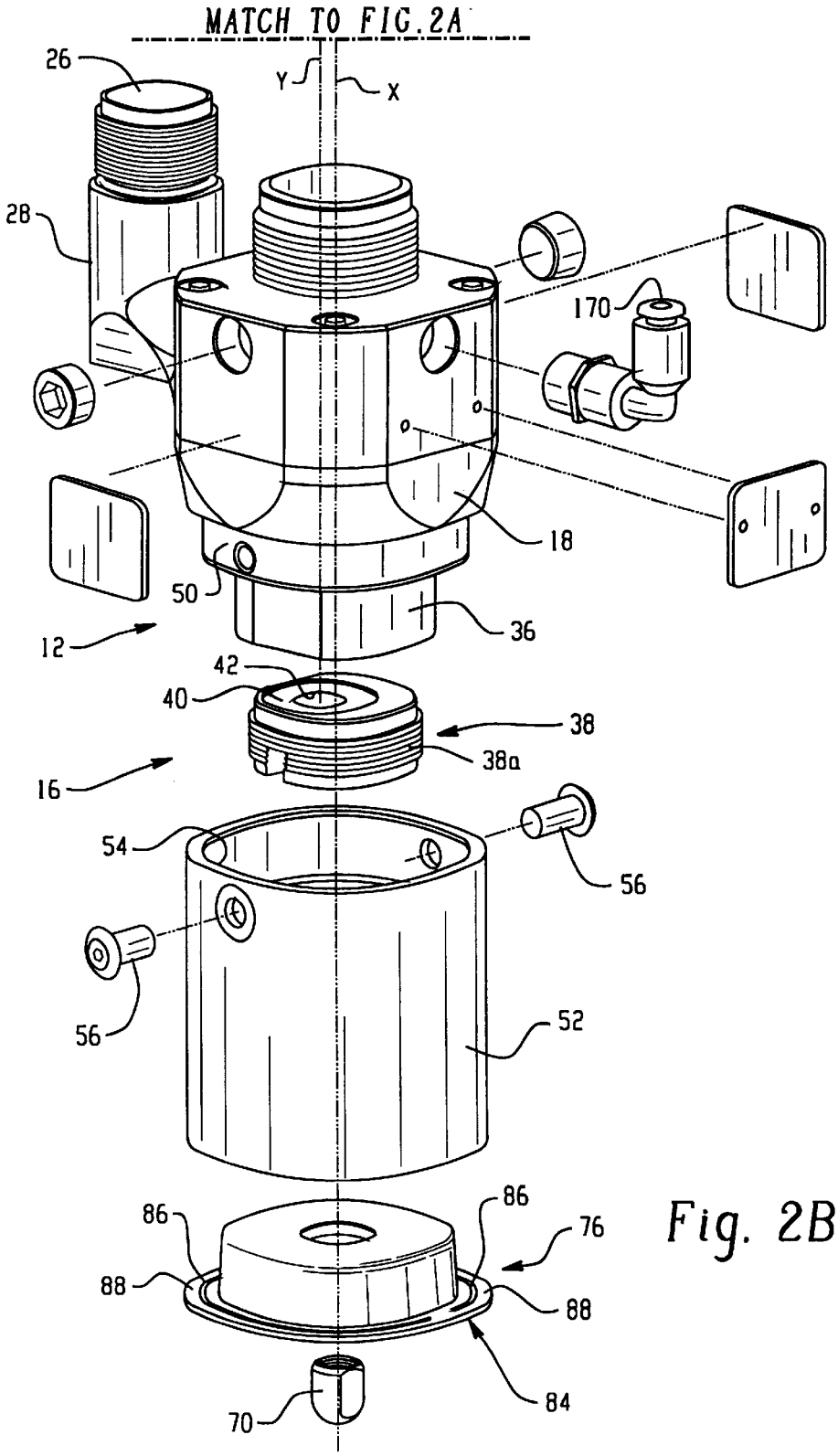

As shown in FIGS. 2A, 2B and 4, an air fitting 170 is provided for supplying cooling air to the motor assembly 12. This cooling air flows through the air passageway 172 between the tube assembly 14 and the motor 12. This air thus also helps cool the eccentric bearing 40. A series of bores 174 are provided in the drive shaft 30 without weakening the strength of the shaft. These slits 174 allow the cooling air to exhaust into the interior volume of the shield 52, more specifically into the upper cup volume 60. The cooling air passes out through the openings 64 and 80 in the shield wall 58 and the liner 76 respectively. This exhaust flow (represented by the arrows AF) is of sufficient velocity to air wash the region around the nozzle 70 and to substantially prevent sprayed material from reversing up into the bearing assembly 16.

In operation, the motor 12 imparts an orbital motion to the nozzle 70 and the dispensing section 102 of the tube assembly 14. The orbit of the nozzle has a radius established by the offset if the eccentric bearing. The dispensing section 102 pivots in the pivot region at the seal 120, and the compliant flexible tube 104 bends and flexes with the orbiting movement of the nozzle 70. The flexible tube 104 thus takes up the stresses induced in the tube assembly 14 due to the nutating notion. Because the flexible tube 104 is firmly constrained at each end, it flexes along a central portion thereof and provides an axially distributed stress concentration. The tube assembly 14 therefore does not exhibit a localized high stress region which would tend to weaken and eventually break a bending tube. Rather, the flexible tube 104 tends to bow along a radius, thus smoothly and evenly distributing the bending stresses caused by the orbiting tube along an axial length of the tube rather than at a highly localized stress point or region. This radial bow is best illustrated in FIG. 5 by the line of curvature or radius C.

The spray pattern width, film thickness and swirl density may be controlled by appropriately selecting the following parameters: orbit diameter, orbit speed, material outlet orifice diameter, material pressure, distance to the surface or work piece and relative traverse speed between the gun and the work piece. Other parameters may also be selected as required.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that invention not be limited to the particular embodiment disclosed as the best mode contemplated for carrying out this invention, but that the invention will include all embodiments falling within the scope of the appended claims.

Having thus described the invention, we claim:

1. A material dispenser comprising:

a dispensing tube assembly having an outlet end with an orifice from which material is dispensed onto a surface, and an inlet end having an opening adapted to receive material from a supply during a dispensing operation; and means for imparting orbital motion to said outlet end relative to an axis;

said tube assembly comprising a first section having said inlet end at a first end thereof, a second section having said outlet end at a first end thereof, and a third section that flexibly joins said first section and second section;

said means for imparting orbital motion being operably coupled to said second section.

2. The dispenser of claim 1 wherein said first section and second section have respective second ends that axially slip fit together to allow pivoting movement between said first and second sections at a pivot region.

3. The dispenser of claim 2 wherein said third section extends through portions of said first section and said second section and axially extends on both sides of said pivot region.

4. The dispenser of claim 3 wherein said pivot region is defined in part by a seal between said slip fit second ends of said first section and said second section; said seal providing a backup seal preventing material from flowing around an outside volume of said second section.

5. The dispenser of claim 3 wherein said third section comprises a flexible tube thorough which material flows from said first section to said second section.

6. The dispenser of claim 5 comprising a flexible tube support that surrounds a portion of said flexible tube to increase hoop strength.

7. The dispenser of claim 6 wherein said tube support comprises a plurality of loops about an outer surface of said flexible tube.

8. The dispenser of claim 7 wherein said loops are formed as a helix.

9. The dispenser of claim 6 wherein said tube support extends across a central portion of said flexible tube; said flexible tube having a first end that is inserted into said first section of said tube assembly and a second end that is inserted into said second section of said tube assembly.

10. The dispenser of claim 9 wherein said tube support has a first end that is snugly inserted into said first section of said tube assembly and a second end that is snugly inserted into said second section of said tube assembly.

11. The dispenser of claim 6 wherein said flexible tube first and second ends are each sealingly inserted into their respective sections of said tube assembly and form primary seals against flow of material into an outside region of said second section.

12. The dispenser of claim 11 wherein said tube assembly first section includes a fluid passageway that opens at one end near said flexible tube central portion and at another end outside the dispenser.

13. The dispenser of claim 2 wherein said means comprises a motor that surrounds a portion of said tube assembly second section between said pivot region and said outlet end.

14. The dispenser of claim 13 wherein said motor rotates an eccentric bearing; said tube assembly second section being journalled in said bearing near said outlet end.

15. The dispenser of claim 2 wherein said third section permits flexure of said tube assembly along an axially extended portion thereof; said third section bending in a radial manner as said outlet end orbits.

16. The dispenser of claim 1 comprising a nozzle mounted on said tube assembly outlet end, and a shield surrounding said nozzle; said dispenser further comprising a shield liner installed on said shield.

17. The dispenser of claim 16 wherein said liner is a replaceable plastic member that is press fit into said shield and includes an opening through which said nozzle extends.

18. The dispenser of claim 17 wherein said means comprises an air cooled motor; said dispenser comprising an air passageway that exhausts motor cooling air through said shield opening to air wash said nozzle and reduce material spray onto said shield.

19. A material dispenser of the type having a main housing, a nozzle extending from said housing, and a shield installed on said housing and that partially surrounds said nozzle; said dispenser comprising:

a shield liner that is removably installed in said shield; said liner and shield having openings therein through which said nozzle extends; and pressurized air flowing through said openings from within said main housing to air wash exterior surfaces of said nozzle.

20. The dispenser of claim 19 wherein said pressurized air is also cooling air for a motor disposed in said main housing.

21. A material dispensing tube assembly for an orbiting type spray gun, comprising:

a material receiving section of the tube assembly, a material dispensing section of the tube assembly with a nozzle associated therewith, and a flexible section of the tube assembly, said flexible section having first and second ends that axially join said dispensing and receiving sections;

said flexible section slip fits at one end into a first end of said dispensing section and slip fits at an opposite end into a first end of said receiving section;

wherein one of said material dispensing section and material receiving section has a first end that inserts into a first end of the other.

22. The tube assembly of claim 21 wherein said flexible section comprises plastic material and said dispensing and receiving sections comprise metal material.

23. The tube assembly of claim 21 wherein a central portion of said flexible section is free to flex and bend during a spraying operation of the gun.

24. The tube assembly of claim 23 wherein said central portion is at least partially surrounded by a support device to increase pressure strength of said flexible section.

25. The tube assembly of claim 24 wherein said support device comprises a spring.

26. The tube assembly of claim 21 wherein said material dispensing section has a first end that slip fits into a first end of said receiving section and pivots with respect thereto.

27. The tube assembly of claim 21 wherein said dispensing section pivots at a seal positioned between said respective first ends of said dispensing and receiving sections.

28. The tube assembly of claim 21 wherein said material receiving section and material dispensing section pivot with respect to each other at a pivot region.

29. The tube assembly of claim 21 wherein said material receiving section and material dispensing section pivot with respect to each other at a pivot region, and said flexible section extends through interior portions of said first and second sections and axially extends on both sides of said pivot region.

30. A material dispenser comprising:

a dispensing tube assembly having an outlet end with an orifice from which material is dispensed onto a surface, and an inlet end having an opening adapted to receive material from a supply during a dispensing operation; and means for imparting orbital motion to said outlet end relative to an axis;

said tube assembly comprising a first section having said inlet end at a first end thereof, a second section having said outlet end at a first end thereof, and a third section that flexibly joins said first section and second section;

a nozzle mounted on said tube assembly outlet end, a shield surrounding said nozzle, and a shield liner installed on said shield; wherein said liner is a replaceable plastic member that is press fit into said shield and includes an opening through which said nozzle extends.

31. The dispenser of claim 30 wherein said means comprises an air cooled motor; said dispenser comprising an air passageway that exhausts motor cooling air through said shield opening to air wash said nozzle and reduce material spray onto said shield.

32. A material dispensing tube assembly for an orbiting type spray gun, comprising:

a material receiving section of the tube assembly, a material dispensing section of the tube assembly with a nozzle associated therewith, and a flexible section of the tube assembly, said flexible section having first and second ends that axially join said dispensing and receiving sections;

said material receiving section and material dispensing section pivot with respect to each other at a pivot region;

wherein one of said material dispensing section and material receiving section has a first end that inserts into a first end of the other.

33. A material dispensing tube assembly for an orbiting type spray gun, comprising:

a material receiving section of the tube assembly, a material dispensing section of the tube assembly with a nozzle associated therewith, and a flexible section of the tube assembly, said flexible section having first and second ends that axially join said dispensing and receiving sections;

said material receiving section and material dispensing section pivot with respect to each other at a pivot region, and said flexible section extends through interior portions of said first and second sections and axially extends on both sides of said pivot region;

wherein one of said material dispensing section and material receiving section has a first end that inserts into a first end of the other.

34. A material dispensing tube assembly for an orbiting type spray gun, comprising:

a material receiving section of the tube assembly, a material dispensing section of the tube assembly with a nozzle associated therewith, and a flexible section of the tube assembly, said flexible section having first and second ends that axially join said dispensing and receiving sections;

said dispensing section pivots at a seal positioned between said respective first ends of said dispensing and receiving sections;

wherein one of said material dispensing section and material receiving section has a first end that inserts into a first end of the other.

* * * * *